US005242017A

United States Patent [19]

Hailey

[11] Patent Number: 5,242,017

[45] Date of Patent: Sep. 7, 1993

[54] CUTTER BLADES FOR ROTARY TUBING TOOLS

[76] Inventor: Charles D. Hailey, 11628 Burning Oaks, Oklahoma City, Okla. 73150

[21] Appl. No.: 816,296

[22] Filed: Dec. 27, 1991

[51] Int. Cl.[5] ..... E21B 10/32; E21B 29/00

[52] U.S. Cl. ..... 166/55.8; 175/263; 175/267

[58] Field of Search ..... 175/267, 269, 263, 268; 166/55.8, 55.7

[56] References Cited

U.S. PATENT DOCUMENTS

| | | | |
|---|---|---|---|
| 309,927 | 12/1884 | Chapman | 175/263 |
| 332,688 | 12/1885 | Wells | 175/263 |
| 1,494,274 | 5/1924 | Morgan | 175/263 |
| 2,284,170 | 5/1942 | Santiago | 255/76 |
| 2,822,150 | 2/1958 | Muse et al. | 255/76 |
| 2,859,943 | 11/1958 | Chadderdon | 166/55.8 |
| 3,050,122 | 8/1962 | Huitt et al. | 166/55.8 |
| 3,331,439 | 7/1967 | Sanford | 175/269 X |
| 3,419,077 | 12/1968 | Sanford | 175/263 |
| 4,431,065 | 2/1984 | Andrews | 175/269 |
| 4,809,793 | 3/1989 | Hailey | 175/265 |
| 4,938,291 | 7/1990 | Lynde et al. | 166/55.8 |

OTHER PUBLICATIONS

SlimDril, Inc. brochure reprinted from 36th(1984–1985) Composite Catalog (four pages).

Kat Tool Inc. brochure on Thru Tubing Tools (Clean--out, Cable Cutters, Tubing Cutters)–four pages.

*Primary Examiner*—Hoang C. Dang

*Attorney, Agent, or Firm*—Dougherty, Hessin, Beavers & Gilbert

[57] ABSTRACT

The invention consists of the shape and design of plural pairs of cutter blades for use in rotary tubing tools which cutter blades have specialized shapes and cutting surfaces for performing certain specific downhole cutting operations adjacent a tubing string.

5 Claims, 2 Drawing Sheets

CUTTER BLADES FOR ROTARY TUBING TOOLS

BACKGROUND OF THE INVENTION

1. Field of the Invention

The invention relates generally to cutter blades for use in rotary tubing tools and, more particularly, but not by way of limitation, it relates to specific ones of improved cutter blades having configurations and hardened surfaces that are particularly adapted for specific grinding, milling and/or cutting attitudes relative to the tubing string.

2. Description of the Prior Art

Prior art cutter blades have been utilized with "through-tubing" tools for clean-out, cable cutting, tubing cutter function, etc., and such cutting blades are available from such as Kat Tool, Inc. of New Iberia, La. These cutter blades are hardface reinforced with tungsten carbide surfaces and such tools are available in a number of diametric sizes for accommodation in selected tubing dimension. These tools were generally constructed of knife-like configuration. U.S. Pat. No. 3,050,122 in the name of Hewitt et al. discloses a rather heavier duty rotary tool that carries two sets of cutters, an upper set may be actuated so that the cutter blades extend outward radially and cut the casing while a second set of lower cutter blades function to notch the formation below the point where the casing was separated.

The U.S. Pat. No. 2,284,170 illustrates a downhole oil well tool wherein a pair of cutting blades are actuated by fluid pressure into cutting position, whereupon induced rotation of the tool will enable a circular cutting action. U.S. Pat. No. 2,822,150 teaches still another form of rotary, expansible drill bit of the reamer type which may be utilized to enlarge a borehole annulus. Here again, the expansible cutters may be extended hydraulically in response to pressure of drilling fluid that is being circulated down through the tool.

The prior art relating most directly to expansible blades for rotary tubing tools is well characterized in applicant's previously filed U.S. Pat. No. 4,809,793 as issued on Mar. 7, 1989. This patent describes a rotary clean-out tool of the type that could use the cutting blades that are described in the present application. Thus, the tubing clean-out tool may include fluid pressure responsive linear actuators that function above the cutting blade assemblies to expand and retract the blade to operational attitude. Also, the present cutter blades may function in combination with another fluid pressure-responsive, linear actuator which is the subject matter of a patent application entitled "AN IMPROVED DOWNHOLE CUTTING TOOL", Ser. No. 07/815,327, and filed concurrently herewith.

Finally U.S. Pat. No. 1,494,274 discloses a blade configuration that is of the same general type as Applicant's expansible blades, these blades being used in a coal cutting machinery. U.S. Pat. No. 4,431,065 discloses an underreamer blade having isolated hardness features suitable for specific cutting attitudes.

SUMMARY OF THE INVENTION

The present invention relates to improvements in construction of expansible cutting blades that function in pairs within a particular type of rotary tubing tool having two-way thrust control over the expansion of the cutting blades. That is, a hydraulic actuator from above the blades as well as a hydraulic actuator from below the blades forces their respective piston rod ends into contact with the cutting blades thereby to position cutting surfaces of the blades outward into contacting relationship with a surrounding debris formation or other deposit that is being removed. Several specific cutting blade pairs are disclosed, each having different hardness characteristics and configurations, and each being disposed for cutting and/or milling in a particular attitude relative to the tubing tool.

Therefore, it is an object of the present invention to provide cutting tool blades that are suitable for upward reaming movement along a tubing section.

It is also an object of the present invention to provide a pair of elbow blades for use in cutting and reaming out within a tubular section.

It is still further an object of the present invention to provide a cutting and milling head consisting of a pair of opposed blades suitable for cutting and grinding cut tubing sections.

Finally, it is an object of the present invention to provide a pair of cutting blades that form a downward reaming head for cutting waste material and buildup along a diameter slightly larger than the tubing section.

Other objects and advantages of the invention will be evident from the following detailed description when read in conjunction with the accompanying drawings which illustrate the invention.

DETAILED DESCRIPTION OF THE INVENTION

Figure 1:
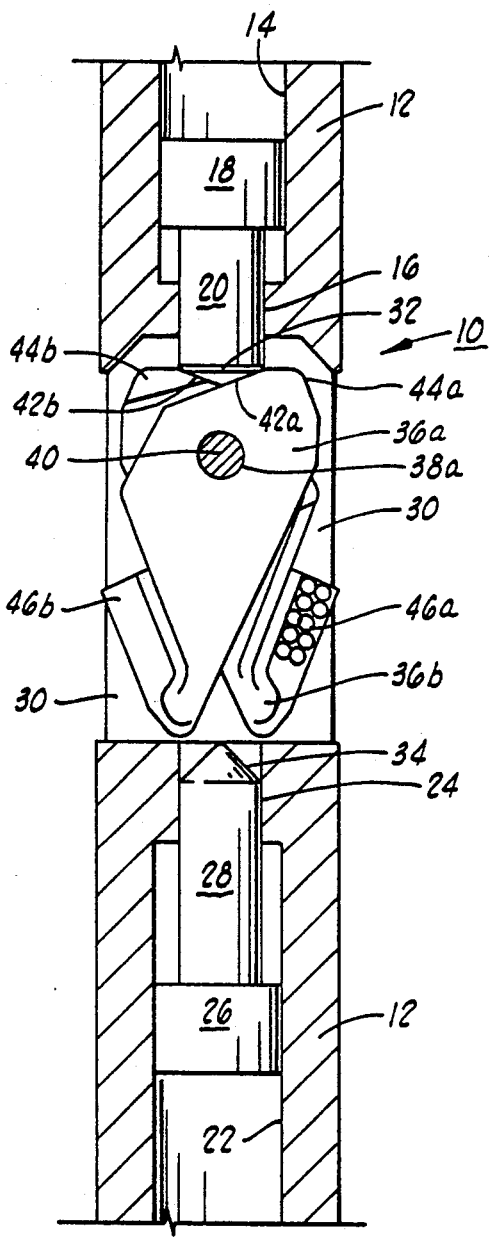
FIG. 1 is an idealized view in vertical section of a rotary tubing tool of the type having both downward and upward acting linear actuators for expanding and reinforcing the expansible cutting blades shown here as fan-type blades in the closed position.

FIG. 1 illustrates a rotary tubing tool 10 of a type that can utilize the expandable blades of the present invention. While only a portion of the rotary tubing tool 10 is shown in idealized form, the complete design is the subject matter of a co-pending U.S. application entitled An Improved Downhole Cutting Tool which is filed concurrently herewith. The rotary tubing tool 10 may normally be used in series with such as a positive-displacement motor which is commercially available to selected specifications from SlimDril, Inc. of Houston, Tex. Also, the bottom end of rotary tubing tool 10 may include additional substructure such as, e.g., a drill or milling head of selected type.

The tubing tool 10 includes a cylindrical body 12 having an axial bore 14 and counterbore 16 slidably receiving a respected piston 18 and piston rod end 20. In like manner, the lower portion of tubing tool 10 includes an axial bore 22 and counterbore 24 which slidably receive a respective piston 26 and piston rod end 28. Intermediate the tool body 12 is a narrow, transverse slotway or cavity 30 extending between a bearing surface 32 of piston rod end 20 and a generally peaked or pointed end 34 of piston rod end 28.

Figure 2:
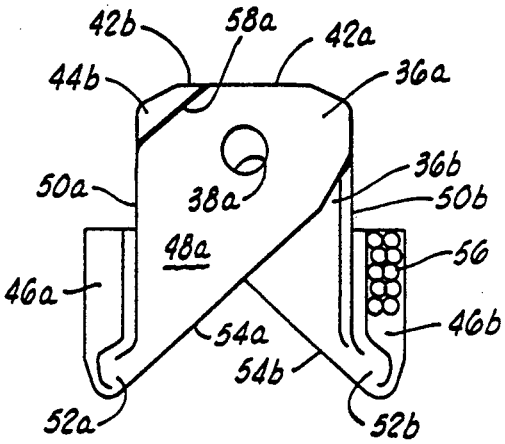
FIG. 2 is a side view of the fan-type blades in the open position.

A pair of cutter blades 36*a* and 36*b* having respective pivot holes 38*a*, 38*b* are aligned for retention on a pivot pin 40, such individual blades 36*a*, 36*b* being disposed in opposed, rotational relationship. Thus, in response to a predetermined fluid pressure in counterbore 14, piston 18 is moved downward. Rod end 20 and contact surface 32 move downward in contact with respective angle edges 42*a*, 42*b* tending to separate the blade corner blocks 44*a*, 44*b*. Successively, drilling fluid pressure from above is applied via longitudinal porting (not shown) within lower bore 22 to force piston 26 upward such that piston rod end 28 and conical bearing surface 34 contact the lower angle edges 54*a* and 54*b* of blades 34*a*, 34*b* tending to spread them further outward to their fullest expandable movement, as shown in FIG. 2. Thus, piston rod ends 20 and 28 are actuated downward and upward, respectively, to spread the cutter blocks 46*a* and 46*b* fully outboard as shown in FIG. 2.

In the interest of clarity, the tubing tool 10 of FIG. 1 is shown in idealized form with a minimum of structure defined. Thus, the manner in which the pressurized drilling fluid is ported from the upper axial chamber down to the lower extremities of tubing tool 10, and the manner in which various sealing and piston control aspects of the invention are achieved, is fully set forth in the co-pending U.S. patent application entitled An Improved Downhole Cutting Tool as well as Applicant's prior U.S. Pat. No. 4,809,793. The present application is directed to the various cutting plate pairs which function in similar manner when installed in such as the rotary tubing tool 10.

Figure 3:
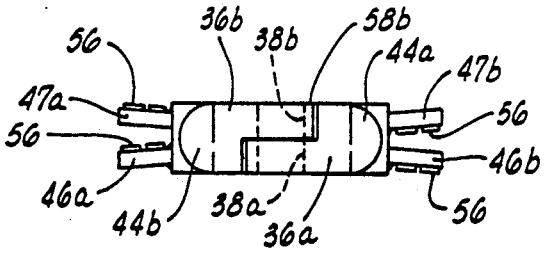
FIG. 3 is an upper end view of the fan-type blades of FIG. 2.

Referring to FIG. 2 and 3, the pair of cutting blades 36*a*, 36*b* are aligned in open configuration, i.e., the cutting attitude. The cutting blades 36*a*, 36*b*, known as a fan-type cutting blade, are configured for upward cutting of a concentric area immediately adjacent the outer skin or surface of cylindrical body member 12.

The cutting blade 36*a* consists of a planar body member 48*a* having upper angle edge 42*a* which extends perpendicularly to an outer edge 50*a* extending to terminus 52*a*. From terminus 52*a* the plate 48*a* extends an acute angular edge 54*a* that once again joins upper angle edge 42*a*. Cutter blades 46*a* and 46*b* are rigidly secured to extend outward from outer edges 50*a* and 50*b*. In fact, as shown in FIG. 3, two such cutter blades extend outward on each side as cutter blocks 46*a* and 47*a* are rigidly secured in parallel as are the opposite side cutter blocks 46*b* and 47*b*. Hardfacing material in the form of tungsten carbide inserts 56, e.g., KU-TRITE TM inserts, are affixed in inset along the right turn-oriented side of the cutter blocks 46 and 47. The tungsten carbide insert 56 array is such that a cutting interface will exist at both the tops of cutter blocks 46, 47 and the outer edges. Note too that when blades 36*a*, 36*b* are fully expanded outward, a corner block 44*b* abuts against angular edge 58*a*. In like manner, a corner block 44*a* (see FIG. 3) abuts against a similar edge 58*b* on the opposite side.

Figure 4:
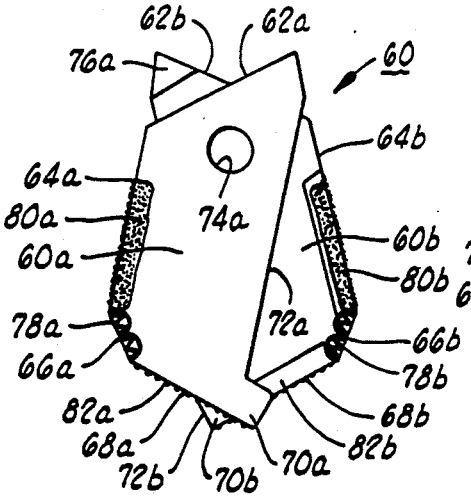
FIG. 4 is a plan view of elbow-type cutting blades when in the closed position.
Figure 5:
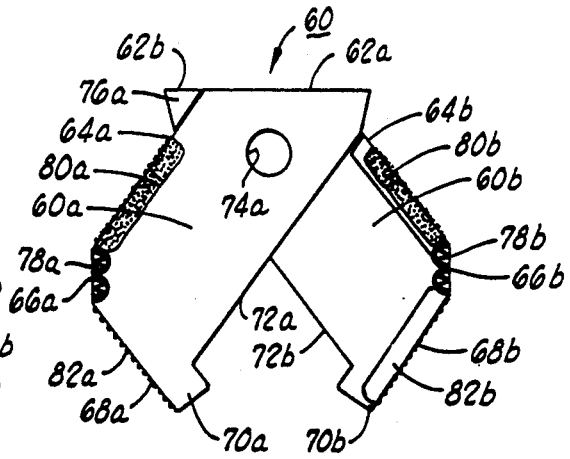
FIG. 5 is a plan view of the elbow-type cutting blades when in the open or expanded position.

FIGS. 4 and 5 show a pair of elbow-type cutter blades 60*a* and 60*b*. Each of the cutter blades 60*a* and 60*b* is formed with an upper angle edge 62*a*, 62*b* extending into an outer edge 64*a*, 64*b* which further joins an elbow surface 66*a*, 66*b*. Adjacent elbow surface 66*a*, 66*b* is a foot edge 68*a*, 68*b* which extends through a terminus 70 to an inner edge 72*a*, 72*b* which returns to the upper angle edge 62*a*, 62*b*. A pivot hole 74*a*, 74*b* is formed through each cutting blade. A corner block 76*a*, 76*b* is formed at the joinder of the upper angle edge to the inner edge 72*a*, 72*b*.

The elbow surfaces 66*a* and 66*b* are adapted to ride around an inner diameter wall in non-abrasive manner; therefore, the elbow surfaces 66 each has flush-mounted inlaid synthetic diamond 78*a*, 78*b*, i.e., the thermally stable polycrystalline diamond material. The outer edges 64*a*, 64*b* are each inset with such as a block of tungsten carbide alloy as block 80*a*, 80*b* are inset and secured with such as silver solder. Similarly, the foot edges 68*a*, 68*b* are formed with insert blocks 82*a*, 82*b* matrices containing natural diamond arrays.

In operation, the cutter blades 60*a*, 60*b* may be employed for reaming out casing, liner or the like with either upward or downward motion as elbow surfaces 66*a*, 66*b* will seek a position adjacent the inside wall of the tubular goods while the grinding and abrading cutting action continues:

It should be understood that the hard-facing types may be selected from a number of well-known types of material. Such materials as synthetic diamond, natural diamond, tungsten carbide hardened steel, KU-TRITE TM, etc. may be employed variously as design choices dictate.

Figure 6:
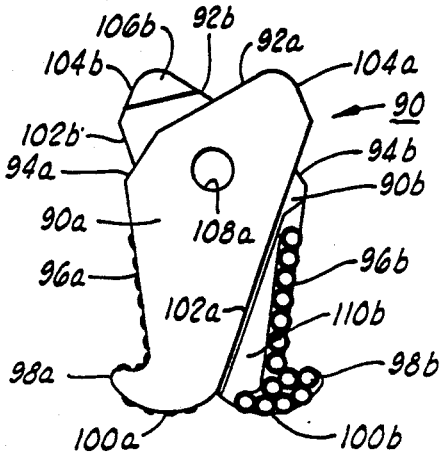
FIG. 6 is a plan view of cutter/miller blades when in the closed position.
Figure 7:
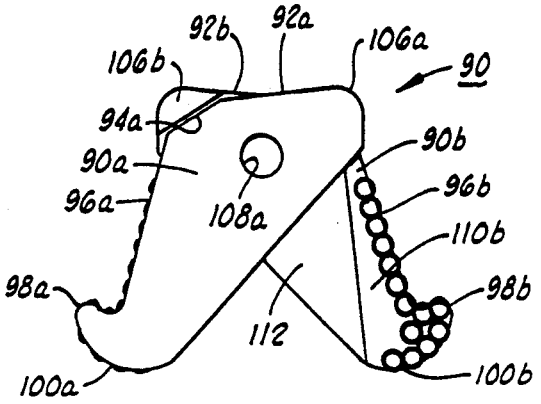
FIG. 7 is a plan view of the cutter/miller blades when in the open position.

Referring now to FIGS. 6 and 7, a pair of cutter blades 90 each consist of an upper angle edge 92, a corner 94 extending into an outer edge 96 and terminating in an outwardly turned terminus toe 98. From terminus toe 98 the shape proceeds through a lower rounded foot 100 and a returning acute angle edge 102 which continues through corner 104 and back to the upper angle edge 92*a*, 92*b*. A corner abutment 106 is formed at corner 104*a*, 104*b* to provide interlocking juncture between adjacent edges 94*a* and 106*b* and 106*a* and 94*b* when blades 90*a*, 90*b* are fully open about the pivot hole 108.

The corner 106*a*, 106*b* and the raised toe portion 110 are approximately twice as thick as the blade portion 112 such that the blades function in plier-type seating about pivot holes 108. Hardfacing such as the tungsten carbide inserts 112 are placed around the outer edge of blades 90 as at edge 96*a*, 96*b*, toe 98*a*, 98*b* and foot 100*a*, 100*b* at the right turn contacting surfaces.

In operation, the cutter blades 90 are employed when it is desired to cut the casing by cutting through the inner wall outward and milling any deposits and casing debris immediately therebelow. The outer point of the toe 98*a*, 98*b* is an effective tubing cutter as foot edge 100*b* provides milling contact.

Figure 8:
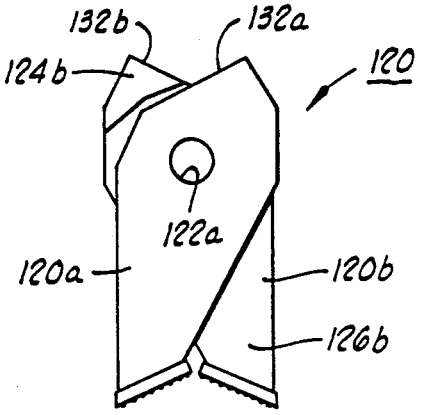
FIG. 8 is a plan view of a pair of reamer blades when in the closed position.
Figure 9:
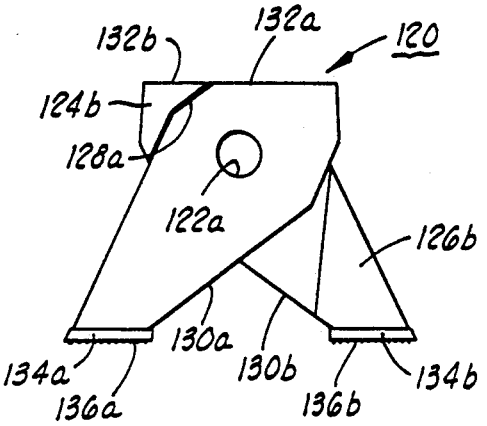
FIG. 9 is a plan view of the downward reamer blades when in the open position.

FIGS. 8 and 9 illustrate a pair of downward reamer blades 120 which function to ream deposits away from the tubing tool in a downward direction relative thereto. The blades 120 each pivot about a pivot hole 122 between the withdrawn position (FIG. 8) and the interlock position (FIG. 9). Each blade includes thickened corner blocks 124 and 126 which lock in abutment with respective corner edge 128 and acute angle edge 130. Upper angle edges 132 provide contact for the downward-bearing piston member to effect outward spreading of the blades to operational condition. Simultaneously, the lower acute angle edges 130*a*, 130*b* are contacted by the upward-bearing piston (see FIG. 1). Each of blades 120*a*, 120*b* includes a lowermost foot pad 134 that is inset with rows of natural diamond 136. The foot pads 134*a* are preformed with the natural diamond set in a selected hardened steel alloy.

Changes may be made in the combination and arrangement of elements as heretofore set forth in the specification and shown in the drawings; it being understood that changes may be made in the embodiments disclosed without departing from the spirit and scope of the invention as defined in the following claims.

What is claimed is:

1. In a rotary tubing tool of the type having radially expandable, opposed pairs of cutting blades, a pair of cutting blades wherein each blade comprises:

a planar body member having an upper angle edge extending between first and remaining sides, an angular edge extending downwardly at approximately 45° from the upper angle edge first side, an outer edge formed from said angular edge at an angle lying generally perpendicular to the upper angle edge and extending to a terminus, a corner block extending from the remaining side of the upper angle edge, and an acute angular edge extending from said terminus upward to join the corner block;

a pivot hole disposed generally centrally through the planar body member;

at least one cutter block secured to extend outward from a lower portion of the outer edge; and hardface cutting material secured on said cutter block to provide upward cutting capability.

2. In a rotary tubing tool, a cutting blade as set forth in claim 1 wherein:

there are two cutter blocks secured in spaced, parallel positions to extend from the terminus upward about halfway along the outer edge.

3. In a rotary tubing tool, a cutting blade as set forth in claim 1 wherein said hardface cutting material comprises:

plural tungsten carbide inserts secured in inset on the upper part of the cutter block.

4. In a rotary tubing tool, a cutting blade as set forth in claim 3 wherein:

there are two cutter blocks secured in spaced, parallel positions to extend from the terminus upward about halfway along the outer edge.

5. In a rotary tubing tool, a cutting blade as set forth in claim 1 which is further characterized in that:

said corner block provides interlocking abutment to angular edge structure of the opposed cutting blade when radially expanded.

* * * * *